US005082127A

United States Patent [19]

Huang

[11] Patent Number: 5,082,127

[45] Date of Patent: Jan. 21, 1992

[54] COLLAPSIBLE LIFT TROLLEY

[75] Inventor: Jeng-Shiung Huang, Chia Yi Hsien, Taiwan

[73] Assignee: Tai Lio Enterprise Co., Ltd., Chia Yi Hsien, Taiwan

[21] Appl. No.: 581,580

[22] Filed: Sep. 11, 1990

[51] Int. Cl.[5] ..... B66C 23/26; B66C 23/44; B66C 23/00

[52] U.S. Cl. ..... 212/265; 212/182; 212/181; 212/261; 414/917

[58] Field of Search ..... 212/182, 181, 203, 261, 212/180, 265, 159; 414/917

[56] References Cited

U.S. PATENT DOCUMENTS

| | | | |
|---|---|---|---|
| 935,170 | 9/1909 | Smith | 212/203 |
| 2,675,209 | 4/1954 | Freed | 212/203 |
| 4,508,233 | 4/1985 | Helms | 212/182 |

*Primary Examiner*—Joseph F. Peters, Jr.
*Assistant Examiner*—Kenneth Lee
*Attorney, Agent, or Firm*—Morton J. Rosenberg; David I. Klein

[57] ABSTRACT

The invention relates to a collapsible lift trolley capable of occupying a compact collapsed position and a deployed in-use position. In accordance with the invention, the collapsible lift trolley comprises a base unit having a turnable wheel, two longitudinal stringers with an end hinged to the base unit to form a support frame when in the deployed position, a support rod upraised from the base unit, a lift arm having an end bent to be hinged on top of the support rod and the other end engaging a hook and a jack interconnecting the support rod and the lift arm for swinging the lift arm relative to the support rod.

1 Claim, 3 Drawing Sheets

COLLAPSIBLE LIFT TROLLEY

BACKGROUND OF THE INVENTION

This invention relates to a collapsible lift trolley.

A known lift trolley, as shown in FIG. 3, comprises a rigid base frame includes two longitudinal stringers 1 firmly interconnected by an end crossbeam 2 and a mid crossbeam 11. A support means 3 upraised from the base frame with the top end 31 thereof pivotally connecting a lift arm 5 of which an outer end is engaged with a hook and a jack 4 interconnects the support means and the lift arm 5 for swinging the lift arm 5 relative to the support means 3.

Said known lift trolley suffers from the major drawback of being difficult in transportation simultaneously with the objects with which they are associated.

SUMMARY OF THE INVENTION

The aim of the present invention is to provide a collapsible lift trolley which is compact in dimension while in its collapsed position, simple in structure and without suffering from the above-mentioned drawbacks.

With the above objectives in view, the present invention provides a collapsible lift trolley capable of occupying a compact collapsed position and a deployed in-use position. The lift trolley according to the present invention comprises a base unit having a turnable wheel, two longitudinal stringers with an end hinged to the base unit to form a support frame when in the deployed position, a support rod upraised from the base unit, a lift arm having an end bent to be hinged on top of the support rod and the other end engaging a hook and a jack interconnecting the support rod and the lift arm for swinging the lift arm relative to the support rod.

DESCRIPTION OF PREFERRED EMBODIMENT

Figure 1:
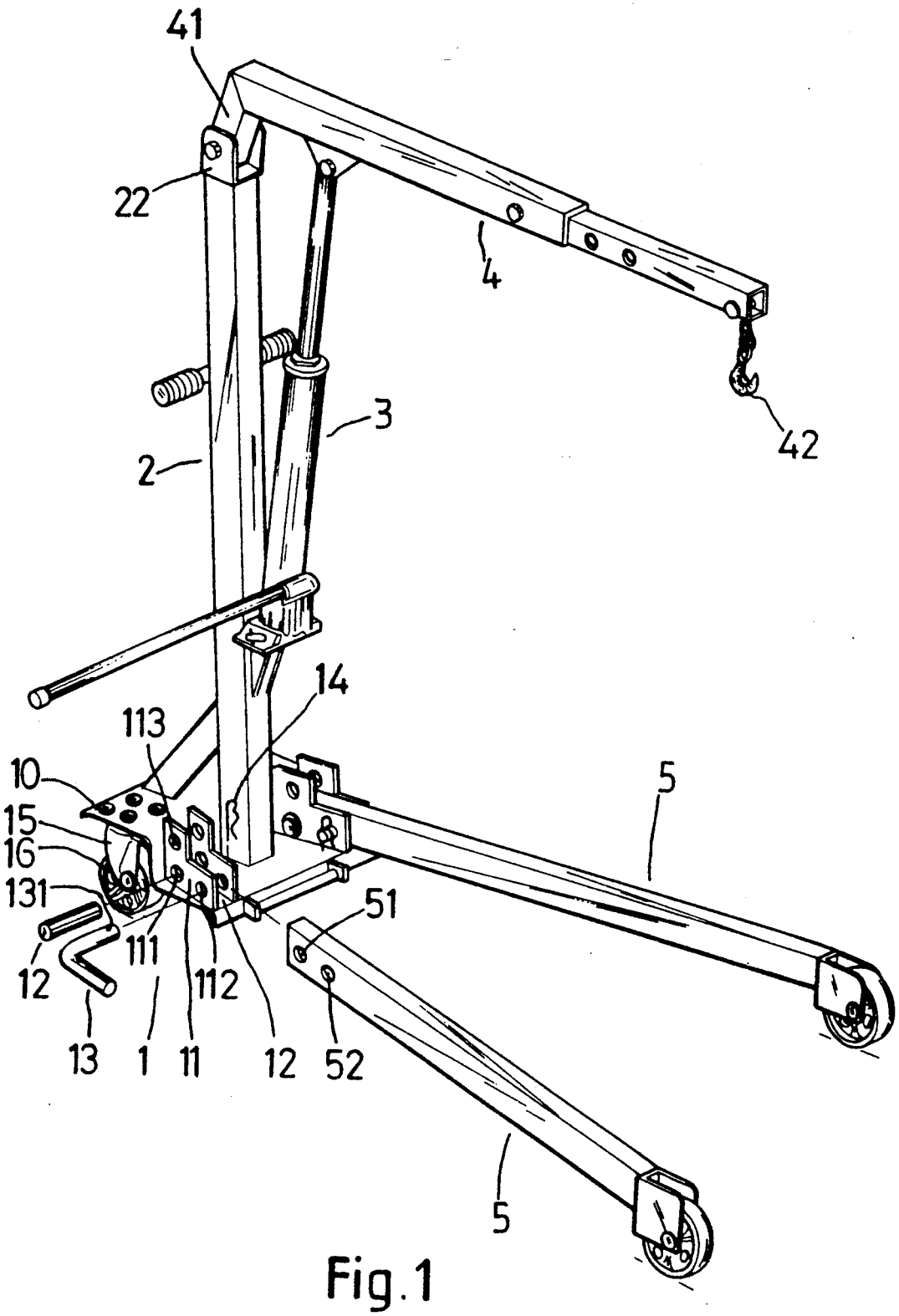
FIG. 1 is a perspective and partially exploded view of a collapsible lift trolley of the present invention which is in deployed position.

As can be seen in the figures, a collapsible lift trolley as defined above comprises a base unit 1, two longitudinal stringers 5 pivotally connected to the base unit 1, a support rod 2 upraised from the base unit 1, a substantially U-shaped band 22 firmly mounted on top of the support rod 2, a lift arm 4 having a bent end 41 ending in an eye (not shown) pivotally connected in the groove of the band 22 by means of a pin and the other end engaging a hook 42 through a chain and a jack 3 interconnecting the lift arm 4 and the support rod 2 for swinging the lift arm 4 relative to the support rod 2.

The base unit 1 includes a step-down platform 10 provided with laterally spaced, downwardly extending brackets 15 which mount the opposite ends of a transverse axle. The axle mounts a wheel 16.

Two spaced connectors 11 are secured on a lower portion of the step-down platform 10. Each connector 11 comprises a pair of L-shaped brackets provided with corresponding pivot holes 111 in a corner portion and two positioning holes in outer portions in equal distance respectively relative to the pivot hole 111. One end of each of the stringers 5 is formed with spaced holes 51, 52 equal in distance to the distance between the pivot hole 111 and either of the other two holes 112, 113. Said end of the stringer 5 is pivotally connected to the connector 11 by means of a pin 12 which extends through aligned holes 111, 51 in the brackets 11 and the stringer 5.

Each of said stringers 5 thus connected can further be secured in position between a deployed position where the stringer 5 extends substantially horizontally and a collapsed position where the stringer 5 extends substantially upwardly by means of a quick disconnect pin 13 which extends into either of the positioning holes 112, 113 and the hole 52 of the stringer 5 in alignment therewith.

Said quick disconnect pin 13 is formed with a transverse key hole 131 in its inner end for retaining inserted pin 13 in position by means of a key 14 which can be inserted through the key hole 13. The outer end of each of the stringers 5 is attached with a wheel. These three wheels support the lift trolley and enable this device to be movable.

Figure 2:
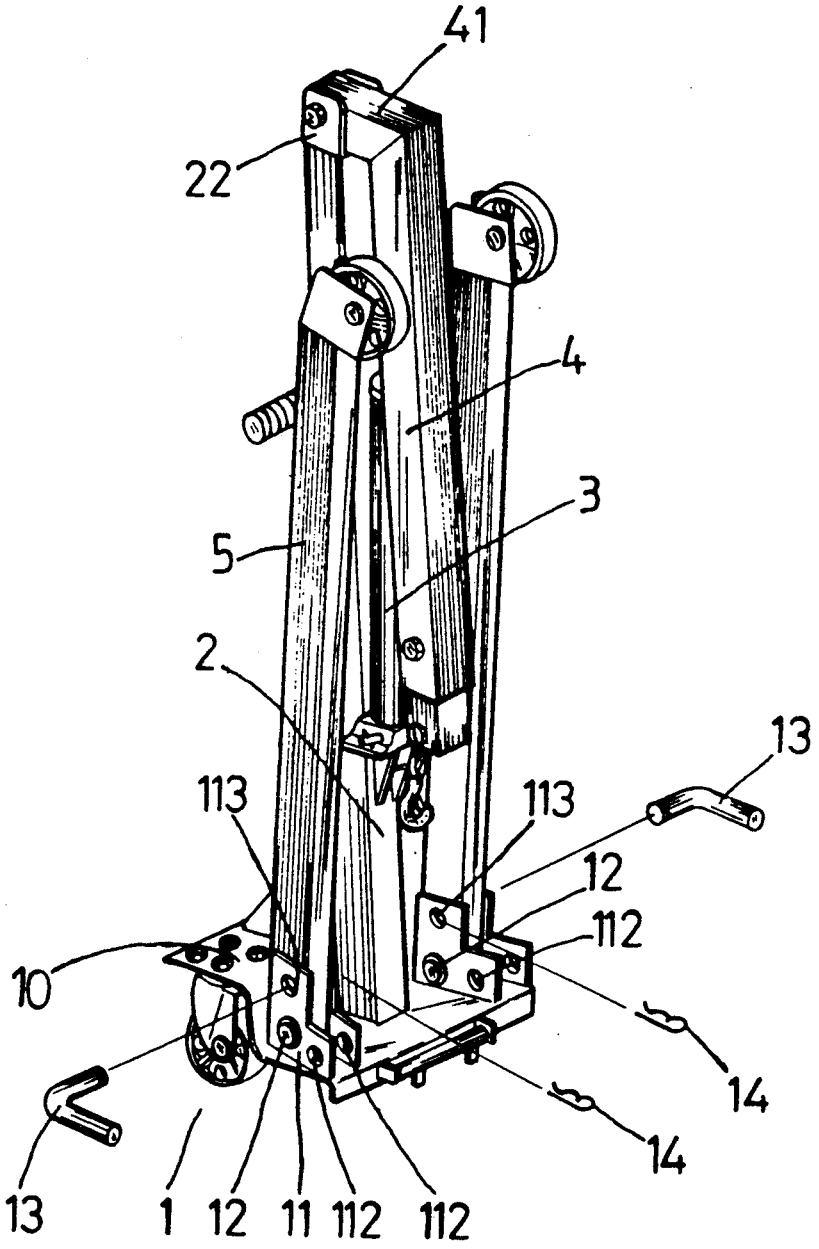
FIG. 2 is a perspective and partially exploded view of the collapsible lift trolley which is in collapsed position.
Figure 3:
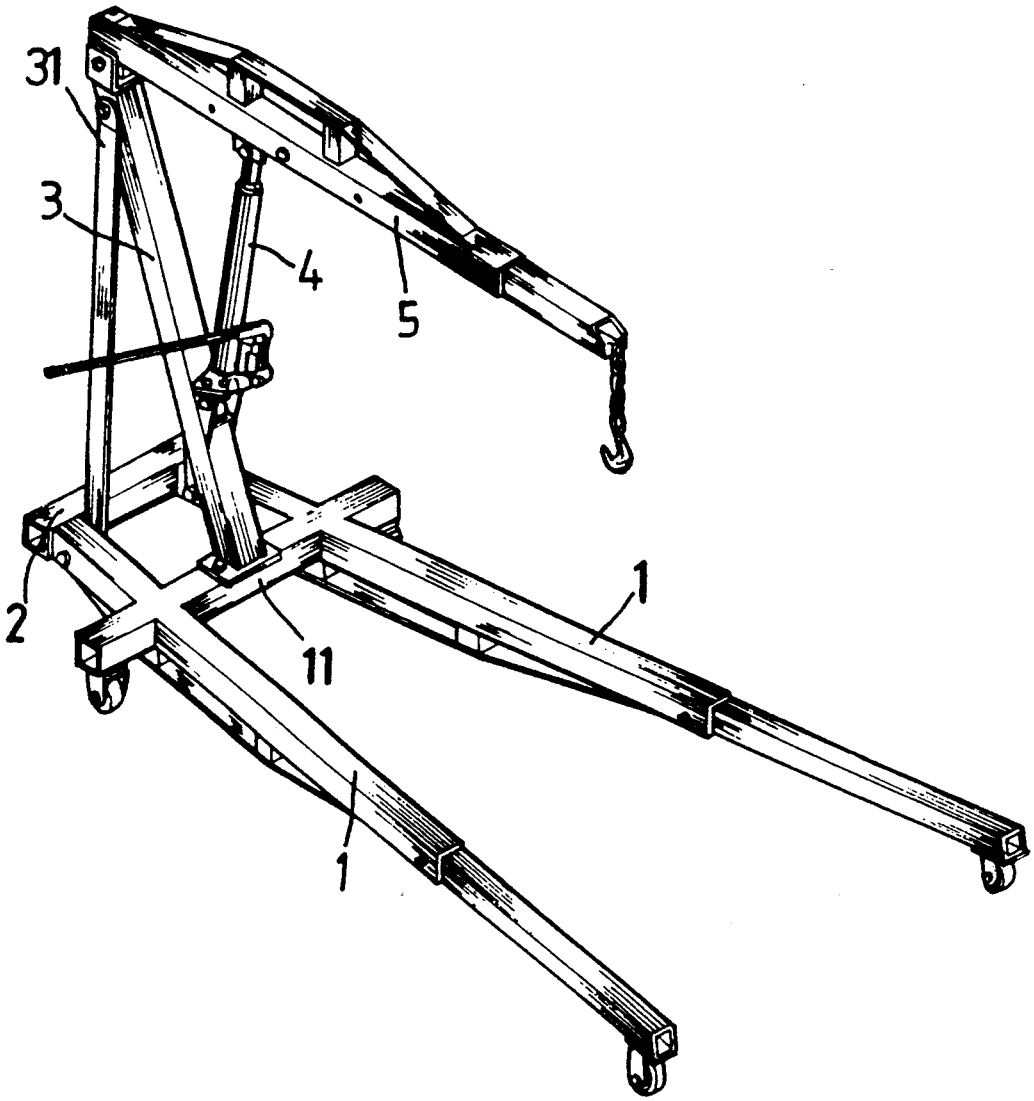
(PRIOR ART) Fig. 3
FIG. 3 is a perspective view of a conventional lift trolley.

As best shown in FIG. 2, the stringers 5 can be swung about the pin 12 into upraised position where the stringers 5 extend substantially parallel to the support rod 2. Further, the piston rod of the jack 3 can be operated to collapse so as to swing the lift arm 4 backwards and downwards. The bent end 41 of the lift arm 4 renders the major portion of the lift arm 4 to extend substantially downwardly and parallel to the support rod 2 while in its collapsed position. The lift trolley of the present invention is compact in size while the device is in its collapsed position.

I claim:

1. A collapsible lift trolley comprising:

a pair of longitudinally directed stringer members fixedly attached and pivoted to a vertically directed support rod to provide for transition from a deployed to a collapsed configuration of said collapsible lift trolley;

a lift arm having a hinged end section bent to allow for a compact structure when said lift trolley is in said collapsed configuration;

base means for stabilizing said lift trolley including a platform member and a wheel secured under the platform member, said base means further including connection means coupled to each of said stringer members and said platform member, said connection means respectively comprising a pair of L-shaped bracket members correspondingly formed with aligned pivot holes formed through a mid-portion thereof and positioning holes formed in outer portions thereof, said positioning holes being equally spaced from said pivot hole of a corresponding bracket member, said positioning holes defining a first position and a second position having an envelope providing a substantially orthogonal configuration, each of said longitudinally directed stringer members having a first end formed with spaced openings at a distance equal to the distance between said pivot hole and either of said positioning holes formed through said connection means, and a second end of each of said longitudinally directed stringer members mounting a wheel;

a pivot pin member extending through said pivot hole in said connection means and said opening in a respective stringer member to pivotally connect said first end of said respective stringer member to said base means;

a quick disconnect pin extending through either of said positioning holes in said connection means to secure said stringer member in either one of said two positions defined by said pivot and positioning holes in said connection means;

a vertically directed support rod extending from said base means and coupled to said lift arm; and, a hydraulic jack fixedly attached to said support rod and said lift arm on opposing ends thereof in a manner such that a displacement from said deployed to said collapsed configuration is provided by folding of said stringer members and lowering of said lift arm in a substantially vertical plane to said collapsed configuration.

* * * * *